US008098206B2

(12) United States Patent
Schätzle

(10) Patent No.: US 8,098,206 B2
(45) Date of Patent: Jan. 17, 2012

(54) ANTENNA ARRANGEMENT FOR HEARING DEVICE APPLICATIONS

(75) Inventor: Ulrich Schätzle, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 369 days.

(21) Appl. No.: 12/309,712

(22) PCT Filed: Jul. 27, 2007

(86) PCT No.: PCT/EP2007/057745

§ 371 (c)(1),
(2), (4) Date: Jan. 27, 2009

(87) PCT Pub. No.: WO2008/012355

PCT Pub. Date: Jan. 31, 2008

(65) Prior Publication Data

US 2009/0315787 A1 Dec. 24, 2009

Related U.S. Application Data

(60) Provisional application No. 60/834,310, filed on Jul. 28, 2006.

(51) Int. Cl.
*H01Q 21/30* (2006.01)

(52) U.S. Cl. ..... 343/725; 343/788

(58) Field of Classification Search ..... 343/720, 343/725, 726, 787, 788, 702, 850, 860
See application file for complete search history.

(56) References Cited

U.S. PATENT DOCUMENTS

| | | | | |
|---|---|---|---|---|
| 5,764,190 | A | 6/1998 | Murch et al. | |
| 6,538,617 | B2 * | 3/2003 | Rochelle | 343/788 |
| 6,690,924 | B1 | 2/2004 | Jan et al. | |
| 6,909,401 | B2 * | 6/2005 | Rutfors et al. | 343/702 |
| 2005/0237254 | A1 | 10/2005 | Kato et al. | |

FOREIGN PATENT DOCUMENTS

| | | | |
|---|---|---|---|
| DE | 11 2004 000 520 | T5 | 3/2006 |
| EP | 0 945 917 | A2 | 9/1999 |
| EP | 1 587 343 | A2 | 10/2005 |
| JP | 2001332930 | A | 11/2001 |
| WO | WO 02/05381 | A1 | 1/2002 |

* cited by examiner

*Primary Examiner* — Michael C Wimer

(57) ABSTRACT

A device having an electric antenna and a magnetic antenna is described, the antennas being spatially arranged in immediate mutual proximity. The electric antenna has at least one current-carrying electric conductor which acts as a resonator for the electric antenna, while the magnetic antenna has a coil with at least one current-carrying conductor loop which acts as an inductor of the magnetic antenna. Thus the electric antenna and the magnetic antenna are spatially arranged relative to each other such that the direction of the current in the electric conductor of the electric antenna extends substantially at right angles to the direction of the current in the conductor loop of the magnetic antenna.

17 Claims, 2 Drawing Sheets

ANTENNA ARRANGEMENT FOR HEARING DEVICE APPLICATIONS

CROSS REFERENCE TO RELATED APPLICATIONS

This application is the US National Stage of International Application No. PCT/EP2007/057745 filed Jul. 27, 2007 and claims the benefit thereof. The International Application claims the benefit of the U.S. provisional patent application filed on Jul. 28, 2006, and assigned application No. 60/834,310, both of the applications are incorporated by reference herein in their entirety.

FIELD OF INVENTION

The invention relates to an antenna arrangement in which a magnetic antenna for a short transmission range and an electric antenna for a longer transmission range are combined in a unit for hearing device applications such that there is no mutual interference.

BACKGROUND OF INVENTION

Hearing devices nowadays can be provided with special devices for wireless transmission for programming or interlinking purposes. This involves the use of both magnetic and electric antennas, which are integrated into the hearing device, although it is difficult to integrate them into a hearing device owing to the confined space. As a rule, a minimum physical size is necessary if a satisfactory antenna gain is to be achieved. If, on the other hand, not just one but a plurality of antennas is to be integrated in a hearing device, for example one antenna for a short transmission range and one for a longer transmission range, integration becomes all the more difficult. The reason is the added problem of arranging the antennas in the confined space in the hearing device housing such that there is as little mutual interference as possible. This problem has not previously been satisfactorily solved.

Hearing devices having two magnetic antennas are already known. Owing to the mutual interference of the two antennas they have to be spaced a minimum distance apart, however. Complex design measures are necessary in order to position the two antennas as far apart as possible. Also already known are, moreover, hearing devices in which an electric Bluetooth antenna has been arranged in direct proximity to magnetic antennas. The mutual interference suppression of the antennas resulting from this arrangement is achieved by complex, multi-stage filtering measures. A relatively large amount of space is required to accommodate complex filters of this kind in hearing device housings. The cost of manufacturing the hearing device is also thereby increased.

SUMMARY OF INVENTION

An object of the invention is to identify a way of arranging a plurality of antennas in immediate mutual proximity without mutual interference occurring. This object is achieved by means of a device according to the independent claim. Further advantageous embodiments of the invention are indicated in the dependent claims.

A device has an electric antenna and a magnetic antenna which are spatially arranged in immediate mutual proximity. The electric antenna in this instance has at least one current-carrying electric conductor which acts as a resonator. The magnetic antenna, on the other hand, has a coil with at least one current-carrying conductor loop which acts as an inductor of the magnetic antenna. The two antennas (20, 30) are spatially arranged relative to each other such that the direction of the current in the electric conductor of the electric antenna extends substantially at right angles to the direction of the current in the conductor loop of the magnetic antenna. This prevents an electromagnetic alternating field generated by the electric antenna from generating any induced currents in the windings of the magnetic antenna. The two antennas can thus be positioned in close proximity without mutual interference.

In one advantageous embodiment of the invention, a filter is arranged between the electric antenna and the magnetic antenna. This additional measure makes it possible to ensure that the two antennas are effectively isolated from each other.

According to a further advantageous embodiment of the invention, the filter is in the form of an LC high pass. Since the frequencies of the two antennas are generally very different from each other, this simple filter is enough to enable the antennas to be effectively isolated from each other. Where the electric antenna has an adapter loop, it is also particularly advantageous to use this adapter loop as an inductor for the LC high pass. This makes it possible to dispense with additional components. In a further advantageous embodiment, the filter is formed by virtue of the arrangement of a capacitor at each end of the adapter loop. This makes it possible to achieve particularly effective isolation of the electric antenna from the magnetic antenna.

In a further advantageous embodiment of the invention, the magnetic antenna is in the form of a cylindrical coil with a ferromagnetic core, the ferromagnetic core being made from a material having a low electric conductivity and also having a low frequency-dependent relative permeability for the frequency of the electric antenna, such that field displacement of the electric antenna is avoided. The magnetic field of the coil is strengthened as a result of the use of the ferromagnetic core. The low electric conductivity of the coil core prevents eddy currents from being induced therein. Its low frequency-dependent relative permeability ensures that there is no disruptive field displacement of the electric antenna.

In a particularly advantageous embodiment of the invention, the antennas are arranged on opposite sides of a printed circuit board. Since, in this case, the two antennas use the same base area of the printed circuit board, a particularly space-saving antenna arrangement is thereby possible.

It is very advantageous for the electric antenna to be in the form of a printed conductor structure on the printed circuit board. An antenna of this kind can be very easily and inexpensively produced. Furthermore, this antenna requires a particularly small amount of space.

According to one advantageous embodiment of the invention, the electric antenna is in the form of a monopole antenna which is fed by an HF generator, the electric antenna having transformer adaptation to the line impedance of the HF generator. As a result of its design and its ease of adaptation to the line impedance, this "inverted F" antenna is well-suited to transmission procedures operating at frequencies of around 2.5 GHz. Since an inductor is already present in the form of a section of this antenna, it is particularly easy to produce a filter to isolate the antennas from each other.

Lastly, according to further embodiments of the invention the device is in the form of a radio relay unit for hearing device applications or in the form of a hearing device. Precisely because of the confined space in such a device, the proposed space-saving antenna arrangement is particularly well-suited to hearing device applications.

BRIEF DESCRIPTION OF THE DRAWINGS

The invention will be explained in more detail below with reference to drawings in which.

DETAILED DESCRIPTION OF INVENTION

Figure 1:
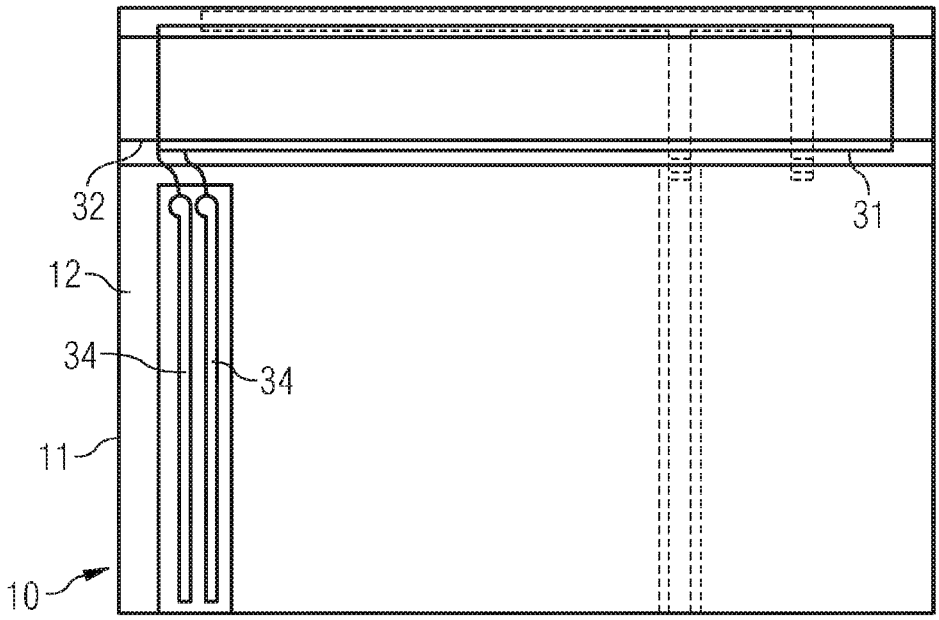
FIG. 1 shows: a printed circuit board of a device with the magnetic antenna.

If electrical devices are to intercommunicate via a wireless transmission path, all the communicating peers have to be provided with a special interface. Apart from a transmission and reception circuit, each device must have an appropriate antenna designed for the particular transmission procedure.

An antenna is a special component that converts electrical energy into electromagnetic waves and vice versa. The way in which an antenna works and its characteristics (effective direction) are determined substantially by its design. This in turn depends primarily on the transmission procedure used and also on the frequencies used. In very simplified terms, an antenna consists of an electric conductor piece through which flows a high-frequency electric current. In the case of a transmitting antenna, the electric current is generated by a generator and fed to the antenna. The charge carriers moving in the conductor generate an electromagnetic field which changes direction at the frequency of the alternating current and propagates in space in a manner characteristic of the antenna in question. If the electric line geometry is adapted to the frequency in question, the line can act as a resonator. The current flowing in the resonator forms a standing wave having an electric and/or magnetic field emitted into space as an electromagnetic wave.

Unlike the transmitting antenna, a receiving antenna converts incoming electromagnetic waves into electrical signals which can then be amplified and processed further. In this case, the electromagnetic alternating field induces an alternating current in the electric conductor, acting as a resonator, of the receiving antenna. In simplified terms, charge carriers in the electric conductor, which are exposed to a changing electromagnetic field, experience a force at right angles to the direction of the magnetic field. The charge carrier motion resulting therefrom causes a flow of current inside the conductor, known as the induced current. Since the direction of the induced current depends on the direction of the magnetic field, an electromagnetic alternating field leads to an alternating current. To achieve the best possible reception, it is necessary to optimize the geometry of the antenna for the particular wavelength received. The alignment of the antenna is also a very important factor in this context.

Typically, antennas intended for a bidirectional wireless transmission path work in both a transmitting and a receiving direction. If two such antennas arranged in close mutual proximity are operated together, there is always the danger that, owing to the induction effects described, the operation of one antenna will be disturbed by the electromagnetic alternating field generated by the adjacent antenna, and vice versa.

There are a large number of antennas intended for very widely differing applications. Depending on which component of the electromagnetic field is used for the transmission of data or energy, a broad distinction can be made between electric or electromagnetic and magnetic antennas. This distinction is somewhat misleading, however, since there is essentially no such thing as a purely magnetic or electric alternating field; instead, owing to their mutual interaction both field components are manifested together in combination.

For this reason a magnetic antenna is, strictly speaking also an electromagnetic antenna, but it is one constructed and arranged such that only the magnetic component of its electromagnetic field is used for linking to further magnetic antennas. With this type of antenna the typical electromagnetic wave is formed only in what is known as the far field. In the near field, on the other hand, only the magnetic component of the electromagnetic field manifests itself. This type of antenna is therefore used, in particular, for short-range radio links. For differentiation purposes a magnetic antenna is frequently also referred to as an inductive antenna or induction antenna.

The main components of a magnetic antenna are generally a coil having a plurality of windings and a tuning capacitor connected to the coil. The two components together form an electrical resonant circuit with a typical resonant frequency. An alternating, current flowing in the coil generates therein an alternating magnetic field which propagates into the space with a typical characteristic. As a rule, a coil antenna also has a ferroelectric core which strengthens the magnetic field inside the coil.

On the other hand, an electric antenna transmits signals mainly with the electric component of the electromagnetic field. A simple electric antenna can be formed from just a linear electric conductor in which a high-frequency current from an HF generator is injected via an infeed connection. The electric antenna used is often what is known as a patch antenna. This antenna variant is especially suitable for integration on printed circuit boards. The patch antenna frequently consists of a rectangular metal coating, the long side thereof being equal to a length of $\lambda/2$. Here the metal coating acts as a resonator. Depending on the design, the patch antenna may be very directional.

In the present example, however, the electric antenna used is preferably a monopole antenna having transformer adaptation to the line impedance of the HF generator. This type of antenna is also referred to as an inverted F antenna. Owing to its design, it is essentially a member of the patch antenna family but, unlike this antenna family, requires no substrate. Like other internal antenna designs, for example spiral antennas or frame antennas, an inverted F antenna occupies only very little space inside the housing of a device. Unlike the other options mentioned, the inverted F antenna is, however, distinguished by its considerable ease of adaptation to the usual impedance level of 50 ohm as a result of the choice of infeed point. This type of antenna is also very inexpensive to make since it can be easily produced as a printed conductor structure on the printed circuit board 11. The name "inverted F antenna" is derived from its profile, which corresponds to the letter "F" lying on its side. The basic structure of this antenna can be seen in FIG. 2. The antenna consists essentially of a horizontal element 21, a first vertical element 22 which is arranged at one end of the horizontal element and is connected thereto, and also of a second vertical element 23 which is spaced a specific distance apart from the first vertical element 22 and is likewise connected to the horizontal element 21. The three elements 21, 22, 23 arranged in an "F" shape form a continuous conductor structure. The length of the horizontal element 21 acting as a resonator is generally $\lambda/4$ with this type of antenna. The first vertical element 22 is preferably connected to ground which, in the present case, constitutes a metal shield face 12' of the printed circuit board 11. The second vertical element 23, on the other hand, forms an infeed pin of the electric antenna 20. An HF generator feeds waves into the electric antenna 20 via this signal connection. For this purpose the infeed pin is connected to a supply lead 24 of the generator. The geometry of the electric antenna 20, in particular the arrangement of the infeed pin 23 along the horizontal element 21, then determines the input impedance. This impedance can be widely varied by an appropriate design or arrangement of the infeed pin 23. The bandwidth of the inverted F antenna depends on its overall height and on the surface area of its base plate or on the volume of the shielding housing on which it is mounted. This type of antenna is particularly suitable for small devices operating, in particular, in higher frequency ranges of around 2.5 GHz. It is typically used in Bluetooth devices.

Other types of antenna apart from the inverted F antenna used in the present example can in principle also be used as an electric antenna for the invention. Mention is made here, by way of example, only of the inverted L antenna, which is closely related to the inverted F antenna and which is likewise in the form of a monopole antenna but has no adapter loop and thus no simple transformer adaptation to the line impedance of the HF generator. Although the antennas can in principle be mounted on the printed circuit board 11 as discrete components, owing to the smaller amount of space required it is advantageous to produce this arrangement as a printed conductor structure in the printed circuit board production process.

A special supply line 24 is required to feed into the electric antenna 20 the high-frequency alternating current generated in the HF generator. Unlike with low-frequency currents, the high frequencies mean that the supply line 24 has to fulfill particular conditions so that the high-frequency alternating current can be relayed in as loss-free a manner as possible. In this case the surge impedance of the supply line 24, in particular, is an important factor. This impedance is very dependent on the geometry of the line.

Owing to the small installation dimensions, the signal supply lines 24 for the electric antenna 20 are in the form of what are known as microstrip lines on the printed circuit board 11. Microstrip lines are planar lines used specifically for high-frequency applications. The lines are formed by the printed circuit board 11 acting as a substrate, by a metal strip arranged on the printed circuit board 11, and by a metal coating 12 arranged on the side of the printed circuit board 11 opposite to the electric antenna 20. This metal coating 12 on the underside of the printed circuit board 11 acts as a ground face in this instance. The wave is conducted through the metal strip. The width of the line and the height of the substrate, and also the dielectric constant of the substrate, determine the surge impedance of the line 24 here. The lateral distance between the metal strip and a metal shield face 12', which is in the form of a metal plate on the same side of the printed circuit board 11 as the electric antenna 20, is also a factor in this case.

Since the magnetic antenna 30 operates on a different radio principle and at a distinctly lower frequency than the electric antenna 20 (e.g. magnetic antenna frequency: ~100 kHz, and electric antenna frequency: ~2.4 GHz), a different type of supply line is also necessary. As FIG. 1 shows, the supply line 34 consists of two parallel metal printed conductors arranged on the printed circuit board 11 acting as a substrate. For shielding purposes the printed conductors of the supply line 34 are surrounded on both sides by the metal coating 12. The metal plate 12' on the side of the printed circuit board 11 opposite to the magnetic antenna 30 also forms a further shield of the supply line 34. Each of the two printed conductors is connected by means of soldering points to one end of the electric line 31' forming the coil winding.

Figure 2:
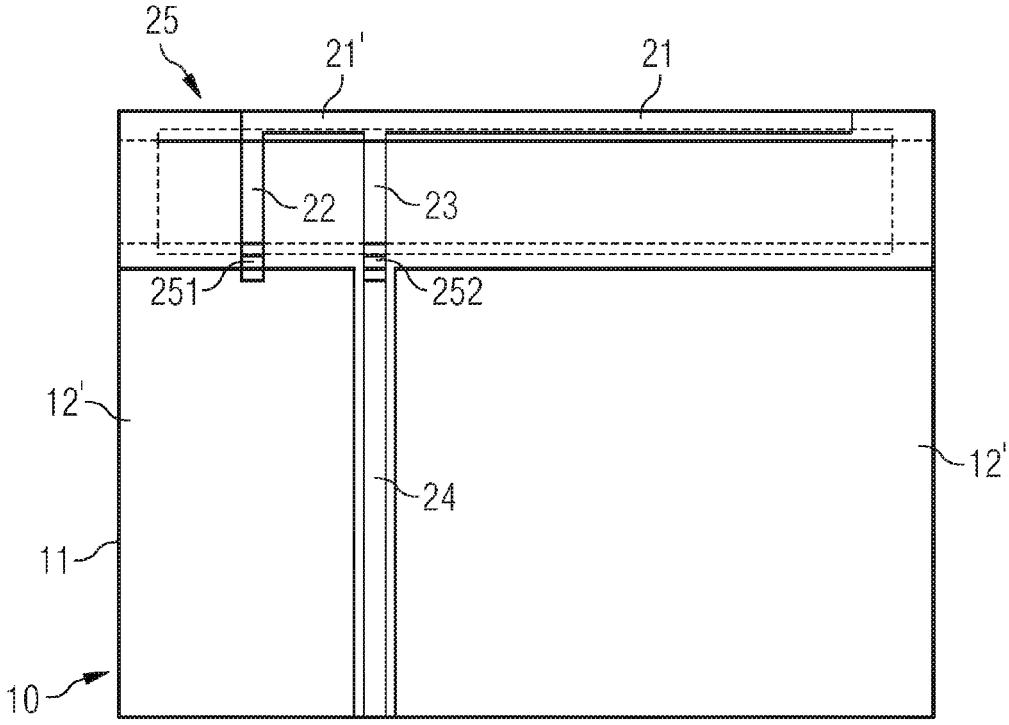
FIG. 2 shows: the back of the printed circuit board with an electric antenna.

As is apparent from FIGS. 1 and 2, the coil 31 of the magnetic antenna 30 and the horizontal element 21 of the electric antenna 20 are arranged parallel to each other. The current-carrying lines 21, 31' of the antennas 20, 30, that is to say the coil windings 31' of the magnetic antenna 30 on the one hand and the horizontal element 21 of the electric antenna 20 on the other hand, are thus arranged at right angles to each other. As a result, the direction of the current in the horizontal element 21 of the electric antenna 20 and the direction of the current in the coil winding of the magnetic antenna 30 also extend substantially at right angles to each other.

Even with these arrangements it is possible that an electromagnetic alternating field generated by the electric antenna 20 will induce an alternating current in the adjacent magnetic antenna 30 and vice versa. A superimposition of such induced currents with the alternating current flowing in the resonator of the electric antenna 20 would cause the operation of the electric antenna 20 to be seriously impaired. Induced currents generated by an electromagnetic alternating field of the electric antenna 20 in the coil of the magnetic antenna 30 would also otherwise seriously impair the operation of this antenna 30.

To reduce further the incidence of induced currents in the antennas 20, 30, such currents being possible despite the advantageous antenna arrangement, it is also proposed that a simple filter 21', 22, 23 be provided between the electric antenna and the magnetic antenna 20, 30. Since the frequency ranges of the magnetic path and of the electric path are very different (e.g. ~100 kHz and 2.5 GHz), even simple filters suppress the mutual interference to an adequate extent. In this context, an LC high pass is very effective and also easy to achieve for the electric antenna 20. Provided that the electric antenna 20 is in the form of an inverted F antenna, as is the case in the present example, the first vertical element and the second vertical element 22, 23, together with the portion 21' of the horizontal element 21 connecting these two elements 22, 23, form an adapter loop for this antenna 20. This adapter loop already constitutes an inductor which can be advantageously used for the LC high pass. All that is additionally needed is for a capacitor to be connected in series. A capacitor 251, 252 is thus preferably arranged at each end of the adapter loop. A filter 25 of this kind is shown in FIG. 2, in which the two capacitors 251, 252 are preferably in the form of SMD components. As a first approximation the capacitors 251, 252 act as closed switches for the electric frequency and as open switches for the magnetic frequency. Since this filter acts in both a transmitting and a receiving direction, the two antennas 20, 30 have virtually no effect on each other despite their immediate proximity.

In order to achieve the greatest possible antenna gain for the electric antenna 20, it is also advantageous in terms of the design of the magnetic antenna 30 if the ferromagnetic core of the magnetic antenna 30 is made of a material with low electric conductivity. This enables eddy current losses to be avoided. Furthermore, the frequency-dependent relative permeability of the ferromagnetic material for the frequency of the electric antenna 20 should be very low, thus enabling field displacements to be effectively avoided.

Figure 3:
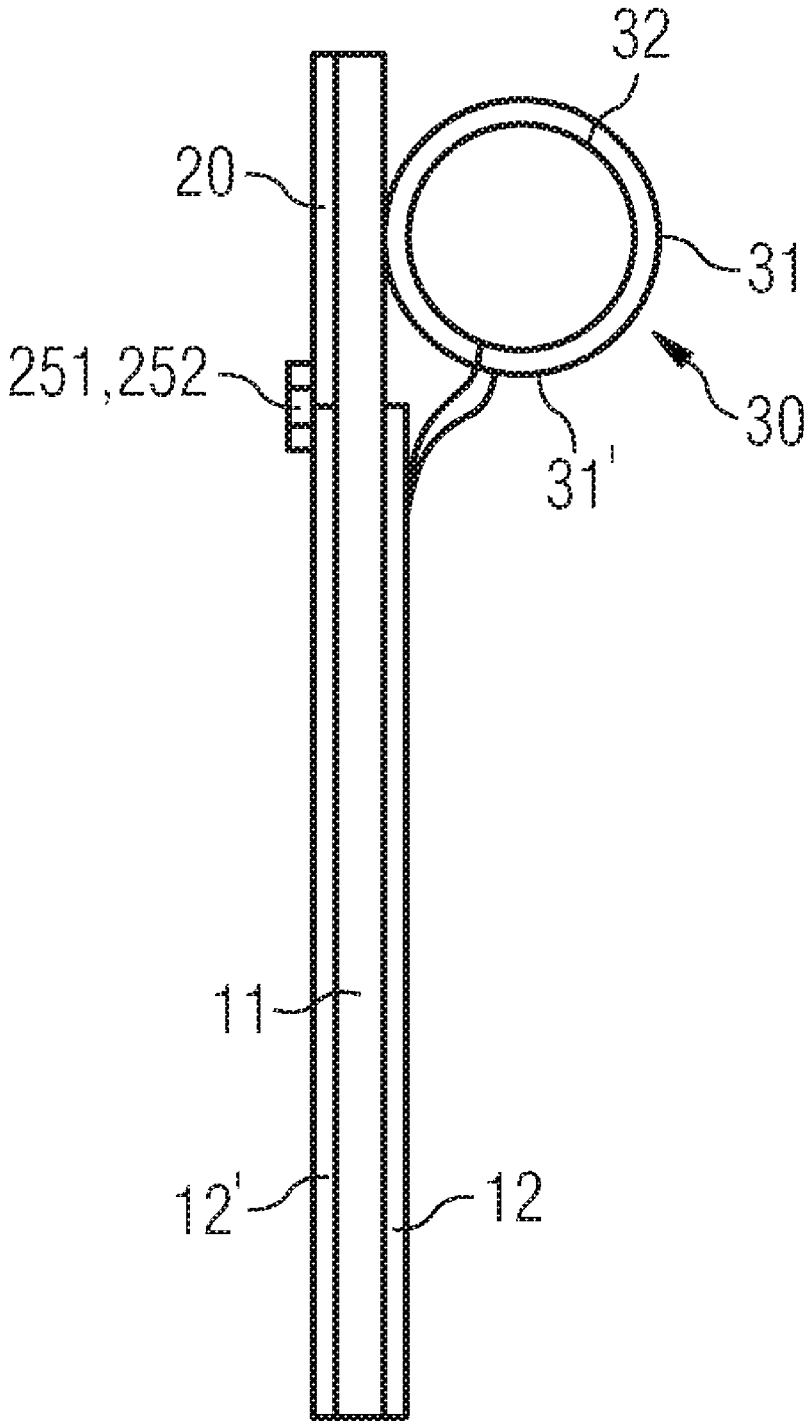
FIG. 3 shows: a side view of the printed circuit board with the electric antenna and the magnetic antenna, one arranged on one side of the printed circuit board and one arranged on the other side.

As FIG. 3 shows, the two antennas 20, 30 make maximum use of the space available to them since, with the measures described, they can be positioned in close mutual proximity on the same base area of the device electronics. Despite this close proximity the antenna gains of the two antennas 20, 30, and thus their signal quality, is very high. There is thus no need for complex filtering measures to isolate the two antennas from each other. Since additional filters of this kind would need more space and would also give rise to higher costs, the arrangement of the antennas 20, 30 enables devices that are smaller and less expensive than in the prior art to be produced for hearing device applications.

It is evident that the subject matter of the invention is not intended to be restricted to the antennas disclosed and described by way of example in this description. On the contrary, the invention covers any electric and magnetic antennas that work in the same way. Owing to the small amount of space required, the arrangement of the electric antenna and the magnetic antenna according to the invention is particularly well-suited to any devices used for hearing device applications. Apart from the hearing devices themselves, this includes remote controls or similar accessory components.

The invention claimed is:

1. A device, comprising:

an electric antenna having at least one current-carrying electric conductor;

a magnetic antenna having a coil with at least one current-carrying conductor loop which acts as an inductor of the magnetic antenna;

a printed circuit board, the electric antenna and the magnetic antenna spatially arranged in immediate mutual proximity on the printed circuit board, the current-carrying electric conductor of the electric antenna extending along the printed circuit board which acts as a resonator, wherein the coil of the magnetic antenna and the current-carrying electric conductor of the electric antenna are arranged in parallel to each other so that an induction of currents in the antennas due to a mutual interference between the antennas is reduced, and a filter arranged between the electric antenna and the magnetic antenna, wherein the filter is in the form of an LC high pass, and wherein the electric antenna further has a first and a second vertical element, the vertical elements and a portion of the current-carrying electric conductor connecting the two vertical elements to each other forming an adapter loop, the adapter loop acting as an inductor of the LC high pass.

2. The device as claimed in claim 1, wherein a capacitor is arranged at each end of the adapter loop.

3. The device as claimed in claim 1, wherein the magnetic antenna is in the form of a cylindrical coil with a ferromagnetic core, the ferromagnetic core being made from a material having a low electric conductivity and also having a low frequency-dependent relative permeability for the frequency of the electric antenna.

4. The device as claimed in claim 1, wherein the magnetic antenna is in the form of a cylindrical coil with a ferromagnetic core, the ferromagnetic core being made from a material having a low electric conductivity and also having a low frequency-dependent relative permeability for the frequency of the electric antenna.

5. The device as claimed in claim 1, wherein the magnetic antenna is in the form of a cylindrical coil with a ferromagnetic core, the ferromagnetic core being made from a material having a low electric conductivity and also having a low frequency-dependent relative permeability for the frequency of the electric antenna.

6. The device as claimed in claim 1, wherein the antennas are arranged on opposite sides of the printed circuit board.

7. The device as claimed in claim 1, wherein the electric antenna is in the form of a printed conductor structure on the printed circuit board.

8. The device as claimed in claim 1, wherein the electric antenna is in the form of a monopole antenna which is fed by an HF generator, the electric antenna having transformer adaptation to the line impedance of the HF generator.

9. The device as claimed in claim 1, wherein the magnetic antenna operates on a different radio principle and at a distinctly lower frequency than the electric antenna.

10. The device as claimed in claim 1, wherein the magnetic antenna operates on a different radio principle and at a distinctly lower frequency than the electric antenna.

11. The device as claimed in claim 1, wherein the magnetic antenna operates on a different radio principle and at a distinctly lower frequency than the electric antenna.

12. The device as claimed in claim 3, wherein the magnetic antenna operates on a different radio principle and at a distinctly lower frequency than the electric antenna.

13. The device as claimed in claim 1, wherein the magnetic antenna operates at a frequency of around 100 kHz and the electric antenna operates at a frequency of around 2.4 GHz.

14. The device as claimed in claim 1, wherein the electric antenna is configured as Bluetooth antenna.

15. The device as claimed in claim 1, wherein the device is in the form of a radio relay unit for hearing device applications.

16. The device as claimed in claim 12, wherein the device is in the form of a radio relay unit for hearing device applications.

17. The device as claimed in claim 1, wherein the device is in the form of a hearing device.

* * * * *